US009360237B2

(12) United States Patent
Huff

(10) Patent No.: US 9,360,237 B2
(45) Date of Patent: Jun. 7, 2016

(54) TRANSCRITICAL REFRIGERANT VAPOR SYSTEM WITH CAPACITY BOOST

(75) Inventor: Hans-Joachim Huff, Mainz (DE)

(73) Assignee: CARRIER CORPORATION, Farmington, CT (US)

( * ) Notice: Subject to any disclaimer, the term of this patent is extended or adjusted under 35 U.S.C. 154(b) by 164 days.

(21) Appl. No.: 14/112,596

(22) PCT Filed: Apr. 3, 2012

(86) PCT No.: PCT/US2012/031926

§ 371 (c)(1), (2), (4) Date: Oct. 18, 2013

(87) PCT Pub. No.: WO2012/145156

PCT Pub. Date: Oct. 26, 2012

(65) Prior Publication Data

US 2014/0053585 A1 Feb. 27, 2014

Related U.S. Application Data

(60) Provisional application No. 61/477,866, filed on Apr. 21, 2011.

(51) Int. Cl.

| | |
|---|---|
| ***F25B 1/00*** | (2006.01) |
| ***F25B 1/10*** | (2006.01) |
| *F25B 6/04* | (2006.01) |

(52) U.S. Cl.

CPC ... *F25B 1/10* (2013.01); *F25B 6/04* (2013.01); *F25B 2309/061* (2013.01); *F25B 2341/0662* (2013.01); *F25B 2400/072* (2013.01); *F25B 2400/075* (2013.01); *F25B 2400/13* (2013.01); *F25B 2400/23* (2013.01)

(58) Field of Classification Search

CPC ..... F25B 1/10; F25B 2341/0662; F25B 2400/23; F25B 6/04; F25B 2400/072

See application file for complete search history.

(56) References Cited

U.S. PATENT DOCUMENTS

| | | | |
|---|---|---|---|
| 4,969,335 | A | 11/1990 | Sasaki et al. |
| 5,228,301 | A | 7/1993 | Sjoholm et al. |
| 5,410,889 | A | 5/1995 | Sjoholm et al. |
| 5,465,587 | A | 11/1995 | Sjoholm et al. |
| 5,477,695 | A | 12/1995 | Sjoholm et al. |
| 6,964,173 | B2 | 11/2005 | Dobmeier et al. |

(Continued)

FOREIGN PATENT DOCUMENTS

| | | | |
|---|---|---|---|
| CN | 101688696 | A | 3/2010 |
| CN | 101688698 | A | 3/2010 |

(Continued)

OTHER PUBLICATIONS

Chinese Office Action for application CN 201280019420.3, dated Feb. 4, 2015, 11 pages.

*Primary Examiner* — Emmanuel Duke
(74) *Attorney, Agent, or Firm* — Cantor Colburn LLP

(57) ABSTRACT

A refrigerant vapor compression system and method of operation are disclosed wherein the first (30*a*) and second (30*b*) compression stages of a two stage compression device are selectively configurable in a first arrangement and a second arrangement. In the first arrangement, the first and second compression stages operate in a series refrigerant flow relationship. In the second arrangement, the first and second compression stages (30*a*), (30*b*) operate in a parallel refrigerant flow relationship.

12 Claims, 3 Drawing Sheets

(56) References Cited

U.S. PATENT DOCUMENTS

| | | | | |
|---|---|---|---|---|
| 2006/0201171 | A1 | 9/2006 | Unger et al. | |
| 2009/0126399 | A1 | 5/2009 | Takegami | |
| 2009/0175748 | A1* | 7/2009 | Bush et al. | 418/5 |
| 2009/0266100 | A1 | 10/2009 | Viegas | |
| 2010/0024470 | A1 | 2/2010 | Lifson et al. | |
| 2010/0132399 | A1* | 6/2010 | Mitra et al. | 62/498 |
| 2010/0199694 | A1* | 8/2010 | Taras et al. | 62/117 |
| 2010/0199715 | A1* | 8/2010 | Lifson et al. | 62/510 |
| 2010/0281894 | A1 | 11/2010 | Huff | |
| 2010/0326100 | A1* | 12/2010 | Taras et al. | 62/115 |
| 2011/0023514 | A1* | 2/2011 | Mitra et al. | 62/222 |
| 2011/0162396 | A1* | 7/2011 | Chen et al. | 62/115 |

FOREIGN PATENT DOCUMENTS

| | | | | |
|---|---|---|---|---|
| CN | 101970953 | A | 2/2011 | |
| EP | 1722173 | A2 | 11/2006 | |
| WO | WO 03019085 | A1 * | 3/2003 | F25B 9/00 |
| WO | WO03019085 | A1 * | 3/2003 | F25B 1/10 |
| WO | 2010036540 | A1 | 4/2010 | |
| WO | WO 2010036540 | A1 * | 4/2010 | F25B 9/00 |

* cited by examiner

TRANSCRITICAL REFRIGERANT VAPOR SYSTEM WITH CAPACITY BOOST

CROSS-REFERENCE TO RELATED APPLICATION

Reference is made to and this application claims priority from and the benefit of U.S. Provisional Application Ser. No. 61/477,866, filed Apr. 21, 2011, and entitled TRANSCRITICAL REFRIGERANT VAPOR SYSTEM WITH CAPACITY BOOST, which application is incorporated herein in its entirety by reference.

BACKGROUND OF THE INVENTION

This invention relates generally to refrigerant vapor compression systems and, more particularly, to boosting capacity of a refrigerant vapor compression system during selected operating conditions.

Refrigerant vapor compression systems are well known in the art and commonly used for conditioning air to be supplied to a climate controlled comfort zone within a residence, office building, hospital, school, restaurant or other facility. Refrigerant vapor compression systems are also commonly used in refrigerating air supplied to display cases, merchandisers, freezer cabinets, cold rooms or other perishable/frozen product storage area in commercial establishments. Refrigerant vapor compression systems are also commonly used in transport refrigeration systems for refrigerating air supplied to a temperature controlled cargo space of a truck, trailer, container or the like for transporting perishable/frozen items by truck, rail, ship or intermodally.

Refrigerant vapor compression systems used in connection with transport refrigeration systems are generally subject to more stringent operating conditions due to the wide range of operating load conditions and the wide range of outdoor ambient conditions over which the refrigerant vapor compression system must operate to maintain product within the cargo space at a desired temperature. The desired temperature at which the cargo needs to be controlled can also vary over a wide range depending on the nature of cargo to be preserved. The refrigerant vapor compression system must not only have sufficient capacity to rapidly pull down the temperature of product loaded into the cargo space at ambient temperature, but also should operate energy efficiently over the entire load range, including at low load when maintaining a stable product temperature during transport.

Traditionally, most of these refrigerant vapor compression systems have been operated at subcritical refrigerant pressures. Refrigerant vapor compression systems operating in the subcritical range are commonly charged with fluorocarbon refrigerants such as, but not limited to, hydrochlorofluorocarbons (HCFCs), such as R22, and more commonly hydrofluorocarbons (HFCs), such as R134a, R410A, R404A and R407C. Although transport refrigerant vapor compression systems charged with such HFC refrigerants, for example R134a, have performed well, interest is being shown in "natural" refrigerants, such as carbon dioxide, for use in refrigeration systems instead of HFC refrigerants for environmental capability reasons. However, because carbon dioxide has a low critical temperature, most refrigerant vapor compression systems charged with carbon dioxide as the refrigerant are designed for operation in the transcritical pressure regime.

SUMMARY OF THE INVENTION

It is desirable that a refrigerant vapor compression system operating in a transcritical cycle, in particular in a transport refrigeration application, provide refrigeration capacity substantially equivalent to a refrigeration vapor compression system operating in a subcritical cycle, particularly under high capacity operation.

A refrigerant vapor compression system includes a first refrigerant heat rejection heat exchanger, a second refrigerant heat rejection heat exchanger, and a refrigerant compression device having a first compression stage and a second compression stage. The first and second compression stages and the first and second refrigerant heat rejection heat exchangers are selectively configurable in a first arrangement and a second arrangement. In the first arrangement, the first and second compression stages operate in a series refrigerant flow relationship and the second refrigerant heat rejection heat exchanger functions as an intercooler for cooling refrigerant passing from the first compression stage to the second compression stage. In the second arrangement, the first and second compression stages operate in a parallel refrigerant flow relationship and the second refrigerant heat rejection heat exchanger functions as a gas cooler for cooling refrigerant passing from the first compression stage.

A method is provided for operating a refrigerant vapor compression system having a compression device having a first compression stage and a second compression stage including the steps of: selectively arranging the first compression stage and the second compression stage in a series flow relationship with respect to refrigerant flow in a first mode of operation; and selectively arranging the first compression stage and the second compression stage in a parallel flow relationship with respect to refrigerant flow in a second mode of operation.

BRIEF DESCRIPTION OF THE DRAWINGS

For a further understanding of the disclosure, reference will be made to the following detailed description which is to be read in connection with the accompanying drawing, wherein.

DETAILED DESCRIPTION OF THE INVENTION

Figure 1:
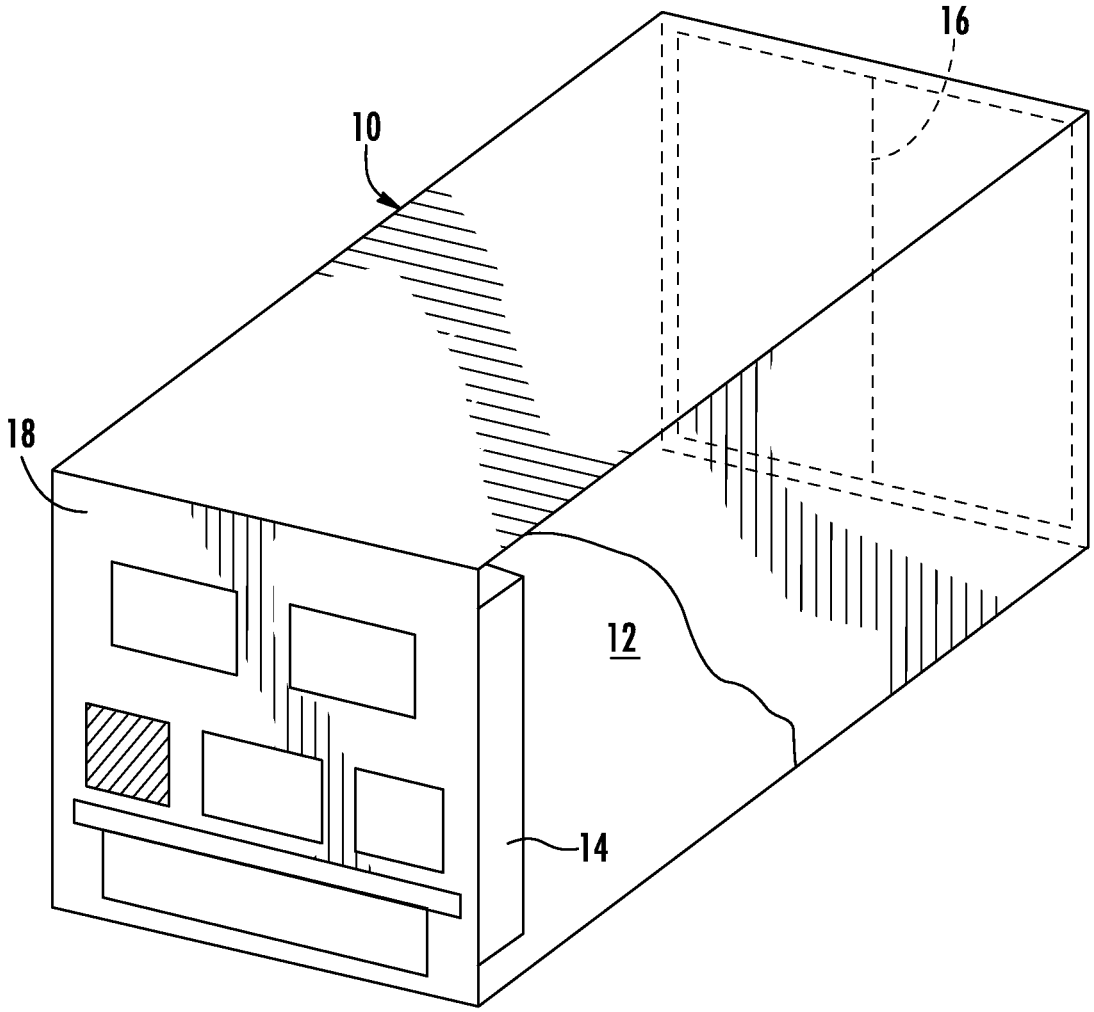
FIG. 1 is perspective view of a refrigerated container equipped with a transport refrigeration unit.

There is depicted in FIG. 1 an exemplary embodiment of a refrigerated container 10 having a temperature controlled cargo space 12 the atmosphere of which is refrigerated by operation of a refrigeration unit 14 associated with the cargo space 12. In the depicted embodiment of the refrigerated container 10, the refrigeration unit 14 is mounted in a wall of the refrigerated container 10, typically in the front wall 18 in conventional practice. However, the refrigeration unit 14 may be mounted in the roof, floor or other walls of the refrigerated container 10. Additionally, the refrigerated container 10 has at least one access door 16 through which perishable goods, such as, for example, fresh or frozen food products, may be loaded into and removed from the cargo space 12.

Figure 2:
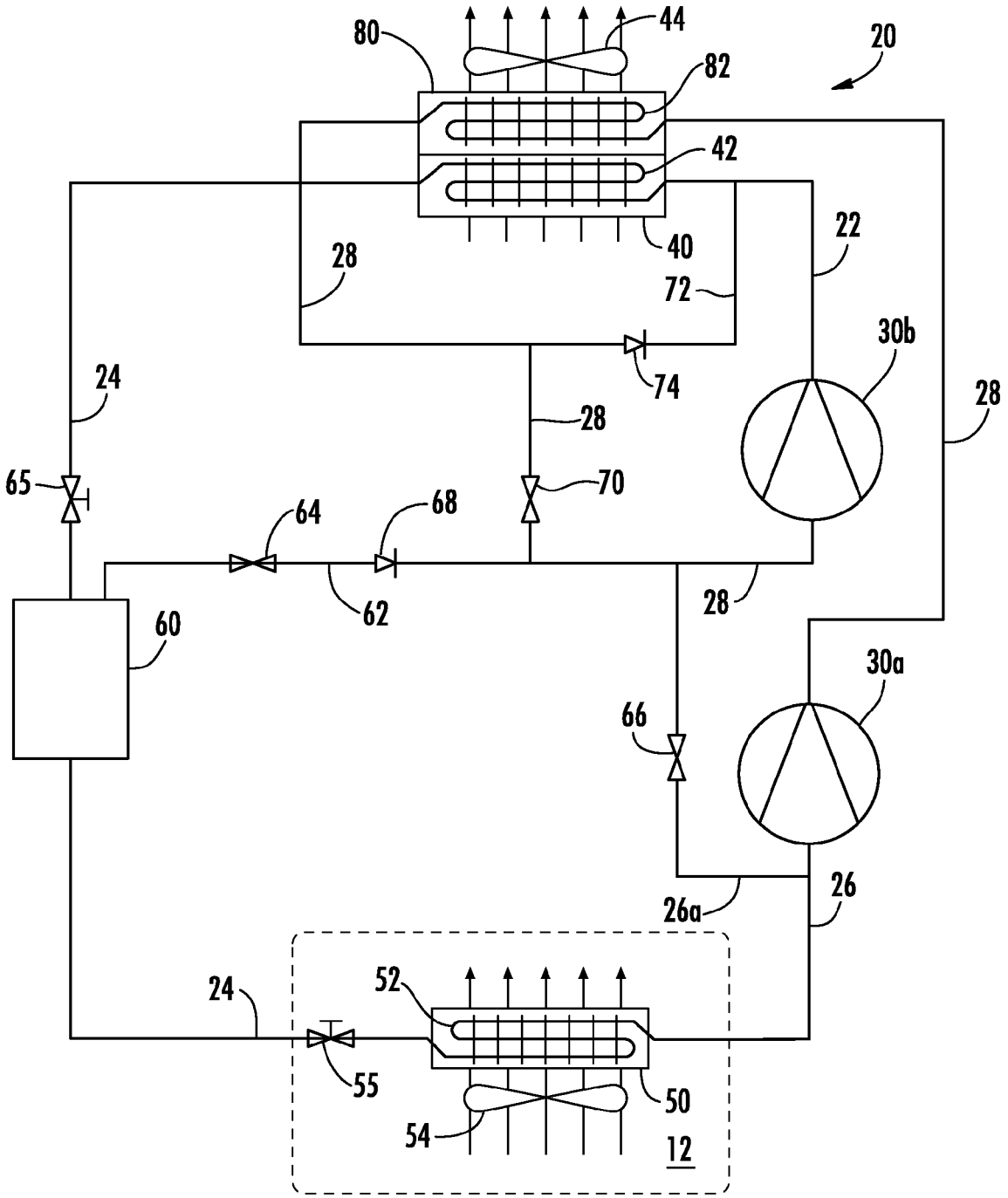
FIG. 2 is a schematic illustration of an embodiment of a refrigerant vapor compression system as disclosed herein.
Figure 3:
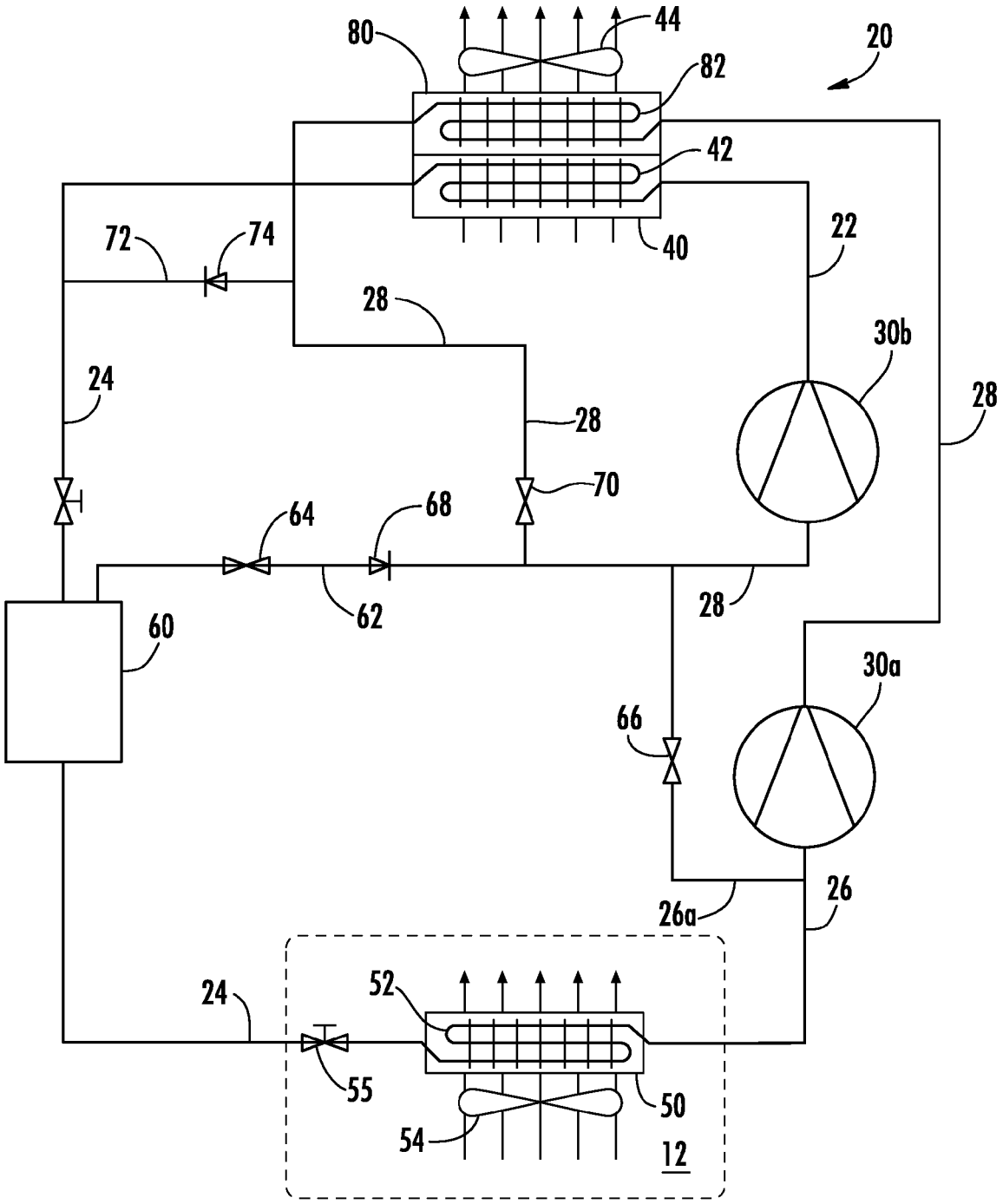
FIG. 3 is a schematic illustration of an alternate embodiment of a refrigerant vapor compression system as disclosed herein.

Referring now to FIGS. 2 and 3, there are depicted schematically exemplary embodiments of a refrigerant vapor compression system 20 suited for operation in a transcritical refrigeration cycle. The refrigerant vapor compression system 20 will be described herein in application for refrigerating air drawn from and supplied back to a temperature controlled cargo space 12 of a refrigerated container, as depicted if FIG. 1, of the type commonly used for transporting perishable goods by ship, by rail, by land or intermodally. It is to be understood that the refrigerant vapor compression system 20 may also be used in refrigeration units for refrigerating the cargo space of a truck, a trailer or the like for transporting perishable goods. The refrigerant vapor compression system 20 is also suitable for use in conditioning air to be supplied to a climate controlled comfort zone within a residence, office building, hospital, school, restaurant or other facility. The refrigerant vapor compression system 20 could also be employed in refrigerating air supplied to display cases, merchandisers, freezer cabinets, cold rooms or other perishable and frozen product storage areas in commercial establishments.

The refrigerant vapor compression system 20 includes a multi-stage compression device 30, a first refrigerant heat rejection heat exchanger 40, also referred to herein as a gas cooler, a refrigerant heat absorption heat exchanger 50, also referred to herein as an evaporator, and a primary expansion device 55, such as for example an electronic expansion valve or a thermostatic expansion valve, operatively associated with the evaporator 50, with various refrigerant lines 22, 24 and 26 connecting the aforementioned components in a primary refrigerant circuit. The refrigerant vapor compression system 20 further includes an economizer circuit associated with the primary refrigerant circuit and incorporating an economizer flash tank 60, and also a branch refrigerant circuit associated with the primary refrigerant circuit and incorporating a second refrigerant heat rejection heat exchanger 80.

The compression device 30 may comprise a single, multiple-stage refrigerant compressor, for example a reciprocating compressor, having a first compression stage 30*a* and a second stage 30*b*, or may comprise a pair of compressors 30*a* and 30*b*, the compressor 30*a* constituting the first compression stage 30*a* and the compressor 30*b* constituting the second compression stage 30*b* of the compression device 30. In a two-compressor embodiment, the compressors may be scroll compressors, screw compressors, reciprocating compressors, rotary compressors or any other type of compressor or a combination of any such compressors. As will be discussed in further detail hereinafter, the first and second compression stages 30*a* and 30*b* may be selectively operated in either a series refrigerant flow relationship or in a parallel refrigerant flow relationship depending upon the system requirements.

As noted previously, the refrigerant vapor compression system 20 further includes an economizer circuit associated with the primary refrigerant circuit. The economizer circuit includes an economizer flash tank 60, an economizer circuit expansion device 65 and a refrigerant vapor line 62. The economizer flash tank 60 is disposed in refrigerant line 24 of the primary refrigerant circuit downstream with respect to refrigerant flow of the first refrigerant heat rejection heat exchanger 40 and upstream with respect to refrigerant flow of the refrigerant heat absorption heat exchanger 50 and the primary expansion device 55 operatively associated with the refrigerant heat absorption heat exchanger 50. The economizer expansion device 65, which may, for example, be an electronic expansion valve, a thermostatic expansion valve or a fixed orifice expansion device, is disposed in refrigerant line 24 upstream with respect to refrigerant flow of the economizer flash tank 60.

The refrigerant vapor line 62 establishes a refrigerant vapor flow path between an upper region of the economizer flash tank 60 and the second compression stage 30*b*. A first flow control device 64 is interdisposed in refrigerant vapor line 62. The flow control device 64 is selectively positionable in an open position wherein refrigerant vapor flow may pass through refrigerant vapor line 62 from the economizer flash tank 60 into the inlet of the second compression stage 30*b* and in a closed position wherein the flow of refrigerant vapor from the economizer flash tank 60 through the refrigerant vapor line 62 is blocked. The first flow control device 64 may, for example, comprise a two-position open/closed solenoid valve.

The refrigerant heat absorption heat exchanger 50 functions as a refrigerant evaporator and comprises a heating fluid to refrigerant heat exchanger 52, such as a fin and round tube coil heat exchanger or a fin and flat, multi-channel tube heat exchanger. Before entering the refrigerant heat absorption heat exchanger 50, the refrigerant passing through refrigerant line 24 traverses the expansion device 55, such as, for example, an electronic expansion valve or a thermostatic expansion valve, and expands to a lower pressure and a lower temperature to enter heat exchanger 52. As the liquid refrigerant traverses the heat exchanger 52, the liquid refrigerant passes in heat exchange relationship with a heating fluid whereby the liquid refrigerant is evaporated and typically superheated to a desired degree. The heating fluid may be air drawn by an associated fan(s) 54 from a climate controlled environment, such as the temperature controlled cargo space 12 associated with the transport refrigeration unit 14, or a food display or storage area of a commercial establishment, or a building comfort zone associated with an air conditioning system, to be cooled, and generally also dehumidified, and thence returned to the climate controlled environment.

The low pressure vapor refrigerant leaving heat exchanger 52 passes into refrigerant line 26 and, depending upon the particular operational mode in which the refrigerant vapor compression system 20 is operating, either to the inlet of the first compression stage 30*a* or to the respective inlets of the first compression stage 30*a* and the second compression stage 30*b*. A branch refrigerant line 26*a* taps off the downstream portion of refrigerant line 26 at a location upstream of the inlet to the first compression stage 30*a* and taps into refrigerant line 28 intermediate the location at which refrigerant vapor line 62 taps into the refrigerant line 28 and the inlet to the second compression stage 30*b*.

A second flow control device 66 is interdisposed in the branch refrigerant line 26*a*. The second flow control device 66 is selectively positionable in an open position wherein refrigerant flow may pass through branch refrigerant line 26*a* into refrigerant line 28 and in a closed position wherein refrigerant vapor flow from refrigerant line 26 into refrigerant line 28 is blocked. The flow control device 66 may, for example, comprise a two-position open/closed solenoid valve. Additionally, a check valve 68 may be disposed in the refrigerant vapor line 62 to prevent reverse flow through the refrigerant vapor line 62.

Each of the first refrigerant heat rejection heat exchanger 40 and the second refrigerant heat rejection heat exchanger 80 comprises a refrigerant to secondary cooling fluid heat exchanger 42, 82, such as a fin and round tube coil heat exchanger or a fin and flat, multi-channel tube heat exchanger. As the refrigerant vapor compression system 20 operates in a transcritical cycle, each of the refrigerant heat rejection heat exchanger 40 and the second refrigerant heat rejection heat exchanger 80 functions as a gas cooler.

The refrigerant discharge outlet of the second compression stage 30*b* is connected through refrigerant line 22 of the primary refrigerant circuit in refrigerant flow communication with the refrigerant inlet of heat exchanger 42 of the first refrigerant heat rejection heat exchanger 40. The hot, high pressure refrigerant vapor discharged from the second compression stage 30*b* passes in heat exchange relationship with the secondary cooling fluid, most commonly ambient air drawn through the heat exchanger 42 by the fan(s) 44, whereby the hot, high pressure refrigerant is cooled. The cooled, high pressure refrigerant vapor passes from the heat exchanger 42 into refrigerant line 24 of the primary refrigerant circuit.

The second refrigerant heat rejection heat exchanger 80 is interdisposed in refrigerant line 28 opens at a first end to the refrigerant discharge outlet of the first compression stage 30*a* and at a second end to the inlet of the second compression stage 30*b*. A third flow control device 70 is interdisposed in refrigerant line 28 at a location intermediate the refrigerant outlet of the heat exchanger 82 of the second refrigerant heat rejection heat exchanger 80 and the location at which the refrigerant vapor line 62 taps into refrigerant line 28. The third flow control device 70 is selectively positionable in an open position wherein refrigerant flow may pass through refrigerant line 28 to the inlet of the second compression stage 30*b* and in a closed position wherein refrigerant flow through refrigerant line 28 to the inlet of the second compression stage 30*b* is blocked. The flow control device 70 may, for example, comprise a two-position open/closed solenoid valve.

The refrigerant circuit of the refrigerant vapor compression system 20 further includes a branch refrigerant line 72 that at its inlet end taps into refrigerant line 28 at a location upstream with respect to refrigerant flow of the third flow control device 70 and downstream of the refrigerant outlet of the heat exchanger 82 and at its outlet end taps into the primary refrigerant circuit at a location downstream with respect to refrigerant flow of the discharge outlet of the second compression stage 30*b* and upstream with respect to refrigerant flow of the economizer circuit. In the embodiment depicted in FIG. 2, branch refrigerant line 72 at its outlet end taps into refrigerant line 22 upstream of the inlet to the heat exchanger 42 of the first refrigerant heat rejection heat exchanger 40. In the embodiment depicted FIG. 3, branch refrigerant line 72 at its outlet end taps into refrigerant line 24 at a location downstream of the outlet to the heat exchanger 42 of the first refrigerant heat rejection heat exchanger 40 and upstream of the economizer expansion device 65. A check valve 74 may be disposed in the branch refrigerant line 72 to prevent reverse flow of refrigerant through the branch refrigerant line 72 from refrigerant line 22 in the FIG. 2 embodiment or refrigerant line 24 in the FIG. 3 embodiment.

During periods of higher cooling demand, such as during pulldown, particularly the initial stages of pulldown, of the temperature within the cargo space 12 of the refrigerated container 10, the refrigerant vapor compression system 20 normally operates in an economized mode to increase cooling capacity. When operating in the economized mode, the first flow control valve 64 is open to allow refrigerant vapor to flow from the economizer flash tank 60 through the refrigerant vapor line 62 and refrigerant line 28 to the inlet of the second compression stage 30*b*. The third flow control valve 70 is also open to allow refrigerant flow through refrigerant line 28 from the discharge outlet of the first compression device 30*a*, through the second refrigerant heat rejection heat exchanger 80 to the inlet to the second compression stage 30*b*. In the economized mode, the second flow control valve 66 is closed. Thus, the first and second compression stages 30*a*, 30*b* are connected in series refrigerant flow relationship, the second refrigerant heat rejection heat exchanger 80 functions as an intercooler, and the capacity of the compression device is being increased through the increased mass flow from the refrigerant vapor supplied from the economizer flash tank 60.

However, applicants have recognized that when operating in an economized mode with carbon dioxide as the refrigerant, under conditions of pulldown from higher cargo space temperatures, particularly in the range from 50° F. to 80° F. (10° C. to 27° C.), the refrigerant pressure within the economizer flash tank 60 can be lower then the mid-stage pressure, that is the refrigerant pressure at the inlet to the second compression stage 30*b*, and the system can not operate in an economized mode and must revert to operation in the non-economized mode.

When the refrigerant vapor compression system 20 is operating in a standard non-economized mode, the first flow control valve 64 is closed thereby blocking refrigerant vapor through the refrigerant vapor line 62. The third flow control valve 70 is open to allow refrigerant flow through refrigerant line 28 from the discharge outlet of the first compression device 30*a*, through the second refrigerant heat rejection heat exchanger 80 to the inlet to the second compression device 30*b*. In the standard non-economized mode, the second flow control valve 66 is closed. Thus, the first and second compression stages 30*a*, 30*b* are again connected in series refrigerant flow relationship and the second refrigerant heat rejection heat exchanger 80 functions as an intercooler, but system capacity is reduced relative to operation in the economized mode.

During pulldown, the capacity of the refrigerant vapor compression system 20 when operating in the standard non-economized mode may not be sufficient to meet cooling demand. Therefore, to boost capacity of the refrigeration vapor compression system 20, high pressure refrigerant from the first compression stage 30*a* after traversing the second refrigerant heat rejection heat exchanger 80 is directed through the branch refrigerant line 72 to combine with the high pressure refrigerant from the second compression stage 30*b*.

When the refrigerant vapor compression system 20 is operating in a capacity boosted non-economized mode, the first flow control valve 64 is closed thereby blocking refrigerant vapor through the refrigerant vapor line 62. The third flow control valve 70 is also closed and the check valve 74 is automatically opened thereby allowing refrigerant flow through refrigerant line 28 from the discharge outlet of the first compression device 30*a*, through the second refrigerant heat rejection heat exchanger 80 and thence through the branch refrigerant line 72, but blocking refrigerant flow through the downstream leg of refrigerant line 28 to the inlet to the second compression device 30*b*. Thus, in the capacity boosted non-economized mode, the second refrigerant heat rejection heat exchanger 80 functions as a gas cooler, but is not an intercooler.

In the embodiment depicted in FIG. 2, the branch refrigerant line 72 opens into refrigerant line 22 of the primary refrigerant circuit upstream with respect to refrigerant flow of the heat exchanger 42 of the first refrigerant heat rejection heat exchanger 40 and thus will traverse the heat exchanger 42 in addition to having previously traversed the heat exchanger 82. In the embodiment depicted in FIG. 3, the branch refrigerant line 72 opens into refrigerant line 24 of the primary refrigerant circuit downstream with respect to refrigerant flow of the heat exchanger 42 of the first refrigerant heat rejection heat exchanger 40 and thus will traverse only the heat exchanger 82 of the second heat rejection heat exchanger 80.

In the capacity boosted non-economized mode, the second flow control valve 66 is opened thereby allowing a portion of the refrigerant vapor flowing through refrigerant line 26 to flow through refrigerant line 26*a* to the inlet of the second compression device 30*b*, whereby low pressure refrigerant vapor leaving the refrigerant heat absorption heat exchanger 50 is supplied to the respective inlets of both the first compression stage 30*a* and the second compression stage 30*b*. Thus, in the capacity boosted non-economized mode, the first and second compression stages are operated in a parallel refrigerant flow relationship thereby increasing the mass flow rate delivered by the compression device 30 and hence increasing the cooling capacity of the system relative to operation in the standard non-economized mode.

The refrigerant vapor compression system 20 may also be operated in an unloaded non-economized mode to shed capacity during periods of low cooling demand. To operate the refrigerant vapor compression system 20 in an unloaded non-economized mode, the first flow control valve 64 is closed thereby blocking refrigerant vapor flow through the refrigerant vapor line 62, the third flow control valve 70 is closed thereby blocking refrigerant flow through refrigerant line 28, and the second flow control valve 66 is opened. With the second flow control valve 66 opened and the third flow control valve 70 closed, substantially all the refrigerant leaving the refrigerant heat absorption heat exchanger 50 passes through refrigerant line 26*a* to the inlet of the second compression stage 30*b*, thereby bypassing the first compression stage 30*a*.

In the refrigerant vapor compression system 20 disclosed herein, the first and second compression stages 30*a*, 30*b* and the first and second refrigerant heat rejection heat exchangers 40, 80 are selectively configurable in a first arrangement and a second arrangement. In the first arrangement, the first and second compression stages 30*a*, 30*b* operate in a series refrigerant flow relationship and the second refrigerant heat rejection heat exchanger 80 functions as an intercooler for cooling refrigerant passing from the first compression stage 30*a* to the second compression stage 30*b*. In the second arrangement, the first and second compression stages 30*a*, 30*b* operate in a parallel refrigerant flow relationship and the second refrigerant heat rejection heat exchanger 80 functions as a gas cooler for cooling refrigerant passing from the first compression stage 30*a*.

A method is provided for operating the refrigerant vapor compression system 20 having a compression device 30 having a first compression stage 30*a* and a second compression stage 30*b* including the steps of: selectively arranging the first compression stage 30*a* and the second compression stage 30*b* in a series flow relationship with respect to refrigerant flow in a first arrangement; and selectively arranging the first compression stage 30*a* and the second compression stage 30*b* in a parallel flow relationship with respect to refrigerant flow in a second arrangement.

When operating the refrigerant vapor compression system for refrigerating air from a cargo space of a refrigerated container for transporting perishable goods, the first compression stage 30*a* and the second compression stage 30*b* may be selectively arranged and operated in a series flow relationship with respect to refrigerant flow when the refrigerant vapor compression system 20 is operating in an economized mode in a first stage of pulldown of a temperature within the cargo space 12 and may be selectively arranged and operated in a parallel flow relationship with respect to refrigerant flow when the refrigerant vapor compression system 20 is operating in a boosted capacity non-economized mode in a second stage of pulldown of a temperature within the cargo space 12.

The method may also include the steps of: passing a flow of refrigerant discharging from the second compression stage 30*b* through the first refrigerant heat rejection heat exchanger 40; and passing a flow of refrigerant discharging from the first compression stage 30*a* through the second refrigerant heat rejection heat exchanger 80. The method may also include the step of passing the flow of refrigerant having traversed the second refrigerant heat rejection heat exchanger 80 to an inlet of the second compression stage 30*b* in the first mode of operation. The method may also include the step of passing the flow of refrigerant having traversed the second refrigerant heat rejection heat exchanger 80 through the first refrigerant heat rejection heat exchanger 40 thereby bypassing the second compression stage 30*b* in the second mode of operation. In an embodiment, the second mode of operation comprises operation of the refrigerant vapor compression system in a boosted capacity non-economized mode. In an embodiment, the first mode of operation comprises operation of the refrigerant vapor compression system in an economized mode.

In the refrigerant vapor compression system 20 disclosed herein, capacity may be boosted during pulldown under high cargo space temperature conditions by switching operation of the compression device 30 from two-stage series refrigerant flow relationship to two-stage parallel refrigerant flow relationship. In addition to improving capacity output during pulldown through operation in the capacity boosted non-economized mode, the refrigerant vapor compression system 20 configured as disclosed herein allows for reduction in the size of the compression device, which reduces overall lifetime power consumption. For example, compression device displacement volume could be reduced by as much as 25-30%. As smaller displacement volume allows for more efficient operation in part-load operation, this reduction in displacement volume available with a refrigerant vapor compression system configured as disclosed herein could result in an overall system efficiency increase of 5-10%.

The terminology used herein is for the purpose of description, not limitation. Specific structural and functional details disclosed herein are not to be interpreted as limiting, but merely as basis for teaching one skilled in the art to employ the present invention. Those skilled in the art will also recognize the equivalents that may be substituted for elements described with reference to the exemplary embodiments disclosed herein without departing from the scope of the present invention.

While the present invention has been particularly shown and described with reference to the exemplary embodiments as illustrated in the drawing, it will be recognized by those skilled in the art that various modifications may be made without departing from the spirit and scope of the invention. Therefore, it is intended that the present disclosure not be limited to the particular embodiment(s) disclosed as, but that the disclosure will include all embodiments falling within the scope of the appended claims.

We claim:

1. A refrigerant vapor compression system comprising: a first refrigerant heat rejection heat exchanger having a refrigerant inlet and a refrigerant outlet; a second refrigerant heat rejection heat exchanger having a refrigerant inlet and a refrigerant outlet; a refrigerant compression device having a first compression stage and a second compression stage; a branch refrigerant line connecting a refrigerant inlet of the first compression stage to a refrigerant inlet of the second compression stage; a flow control device in the branch refrigerant line; the first and second compression stages and the first and second refrigerant heat rejection heat exchangers selectively configurable in a first arrangement wherein the first and second compression stages operate in a series refrigerant flow relationship and the second refrigerant heat rejection heat exchanger functions as an intercooler for cooling refrigerant passing from the first compression stage to the second compression stage, the flow control device closed in the first arrangement, and in a second arrangement wherein the first and second compression stages operate in a parallel refrigerant flow relationship and the second refrigerant heat rejection heat exchanger functions as a gas cooler for cooling refrigerant passing from the first compression stage, the flow control device open in the second arrangement.

2. A system as recited in claim 1 wherein in the second arrangement, the first rejection heat rejection heat exchanger functions as a gas cooler for cooling refrigerant passing from the second compression stage only.

3. A system as recited in claim 1 wherein in the second arrangement, the first rejection heat rejection heat exchanger functions as a gas cooler for cooling refrigerant passing from both the first compression stage and the second compression stage.

4. A refrigerant vapor compression system comprising: a refrigerant compression device having a first compression stage and a second compression stage; a first refrigerant heat rejection heat exchanger having a refrigerant inlet and a refrigerant outlet; a second refrigerant heat rejection heat exchanger having a refrigerant inlet and a refrigerant outlet; a first refrigerant line in refrigerant flow communication with a refrigerant discharge outlet of the second compression stage, the first refrigerant heat rejection heat exchanger disposed in the first refrigerant line; a second refrigerant line connecting a refrigerant discharge outlet of the first compression stage in refrigerant flow communication with a refrigerant inlet of the second compression stage, the second refrigerant heat rejection heat exchanger disposed in the second refrigerant line between the first compression stage and the second compression stage; a third refrigerant line connecting the second refrigerant line in refrigerant flow communication with the first refrigerant line, the third refrigerant line tapping into the second refrigerant line at a location; a flow control valve interdisposed in the second refrigerant line downstream with respect to refrigerant flow of the location, said flow control valve being selectively positionable between an open position and a closed position; and a check valve disposed in third refrigerant line, said check valve operative to allow refrigerant flow to pass through the third refrigerant line from the second refrigerant line to the first refrigerant line and to prevent refrigerant flow through the third refrigerant line from the first refrigerant line to the second refrigerant line.

5. A method for operating a refrigerant vapor compression system having a compression device having a first compression stage and a second compression stage, the method comprising the steps of: selectively arranging the first compression stage and the second compression stage in a series flow relationship with respect to refrigerant flow in a first mode of operation; and selectively arranging the first compression stage and the second compression stage in a parallel flow relationship with respect to refrigerant flow in a second mode of operation; wherein a branch refrigerant line connects a refrigerant inlet of the first compression stage to a refrigerant inlet of the second compression stage and a flow control device is positioned in the branch refrigerant line; wherein in the first mode of operation the flow control device is closed and in the second mode of operation the flow control device is open.

6. The method as recited in claim 5 further comprising the steps of:

passing a flow of refrigerant discharging from said second compression stage through a first refrigerant heat rejection heat exchanger; and passing a flow of refrigerant discharging from said first compression stage through a second refrigerant heat rejection heat exchanger.

7. The method as recited in claim 6 further comprising the step of:

passing the flow of refrigerant having traversed the second refrigerant heat rejection heat exchanger to an inlet of said second compression stage in the first mode of operation.

8. The method as recited in claim 6 further comprising the step of:

passing the flow of refrigerant having traversed the second refrigerant heat rejection heat exchanger through the first refrigerant heat rejection heat exchanger thereby bypassing the second compression stage in the second mode of operation.

9. The method as recited in claim 5 wherein the second mode of operation comprises operation of the refrigerant vapor compression system in a boosted capacity non-economized mode.

10. The method as recited in claim 5 wherein the first mode of operation comprises operation of the refrigerant vapor compression system in an economized mode.

11. The method as recited in claim 5 further comprising the step of operating the refrigerant vapor compression system for refrigerating air from a cargo space of a refrigerated container for transporting perishable goods.

12. The method as recited in claim 11 further comprising the steps of:

selectively arranging the first compression stage and the second compression stage in a series flow relationship with respect to refrigerant flow when the refrigerant vapor compression system is operating in an economized mode in a first stage of pulldown of a temperature within the cargo space; and selectively arranging the first compression stage and the second compression stage in a parallel flow relationship with respect to refrigerant flow when the refrigerant vapor compression system is operating in a boosted capacity non-economized mode in a second stage of pulldown of a temperature within the cargo space.

* * * * *